US011591817B2

(12) United States Patent
Kavaldjiev

(10) Patent No.: US 11,591,817 B2
(45) Date of Patent: Feb. 28, 2023

(54) STIFF-TO-FLEXIBLE RISING-TWIST-SWAY SPLIT-FORCE-IMPACT STRUCTURES

(71) Applicant: Boytcho Kolev Kavaldjiev, Spring, TX (US)

(72) Inventor: Boytcho Kolev Kavaldjiev, Spring, TX (US)

( * ) Notice: Subject to any disclaimer, the term of this patent is extended or adjusted under 35 U.S.C. 154(b) by 0 days.

(21) Appl. No.: 17/365,428

(22) Filed: Jul. 1, 2021

(65) Prior Publication Data

US 2023/0003044 A1 Jan. 5, 2023

(51) Int. Cl.
*E04H 9/02* (2006.01)
*E04B 1/41* (2006.01)

(52) U.S. Cl.
CPC ..... *E04H 9/021* (2013.01); *E04B 1/40* (2013.01)

(58) Field of Classification Search
CPC ..... E04B 1/40; E04H 9/021
USPC ..... 52/167.1
See application file for complete search history.

(56) References Cited

U.S. PATENT DOCUMENTS 3,073,065 A * 1/1963 Alderman ..... E01C 23/0986 29/451
4,040,220 A * 8/1977 Henager ..... E04C 5/012 52/745.19
4,736,558 A * 4/1988 Taraba, Jr. ..... E04B 1/6812 52/309.8
5,365,713 A * 11/1994 Nicholas ..... E04B 1/681 52/573.1
5,599,106 A * 2/1997 Kemeny ..... F16C 29/04 384/36
6,324,795 B1 * 12/2001 Stiles ..... E02D 27/34 52/167.7
7,784,225 B2 * 8/2010 Kemeny ..... E04H 9/0235 52/167.1
8,156,696 B2 * 4/2012 Hubbard ..... E04H 9/023 52/167.6
9,109,357 B2 * 8/2015 Moreno ..... E04B 1/98
10,822,761 B1 * 11/2020 Voyen ..... E02D 27/12
10,837,192 B2 * 11/2020 Moreno ..... E02D 31/08
2011/0222800 A1 * 9/2011 Hubbard ..... F16M 13/02 384/36
2018/0209568 A1 * 7/2018 Gill ..... F16L 25/12

* cited by examiner

*Primary Examiner* — Brian E Glessner
*Assistant Examiner* — James J Buckle, Jr.

(57) ABSTRACT

This invention improves seismic resistance of structures by transition from stiff to non destructible flexible state at a threshold earthquake level higher than prior art maximum design earthquake level of stiff structures. Functional characteristics of the category of auto-reversing stiff-to-flexible seismic structures comprise: a limited six degree of freedom motion; a laterally-stable limited rising-twist-sway ascent; a self-centering diagonal-untwist auto-descent; a multidirectional flexibility; and a multi-phase split-force-impact seismic protection. Seismic construction technologies of the category of structures comprise: base split-force-impact technology; cluster split-force-impact technology; tuned segment split-force-impact technology; and tuned spine split-force-impact technology. The auto-reversing stiff-to-flexible seismic joints of the structures are low-cost, simple and easy to manufacture, and especially suitable for mass industrial application.

10 Claims, 2 Drawing Sheets

Fig. 1-a
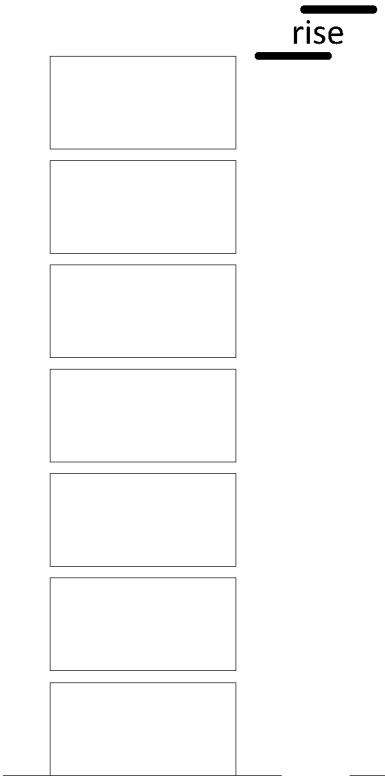
Fig. 1-b
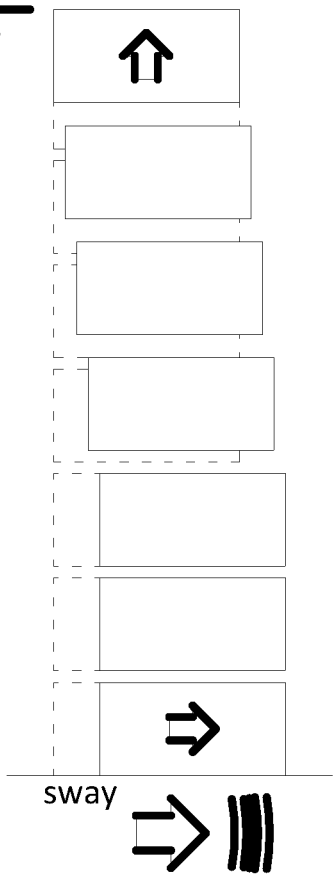
Fig. 1-c
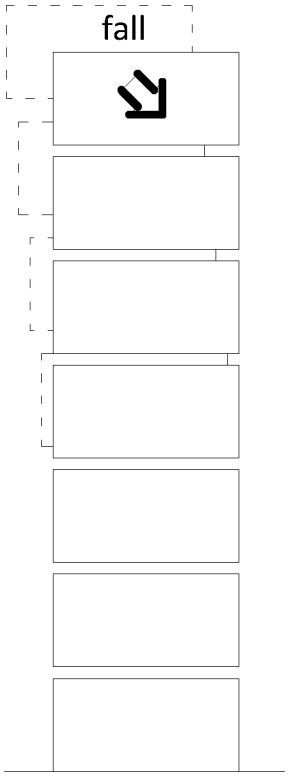
Fig. 2-a
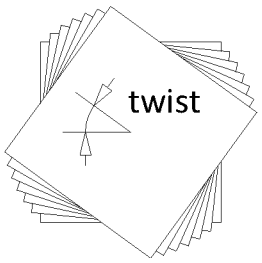
Fig. 2-b
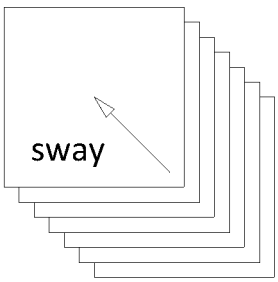
Fig. 2-c
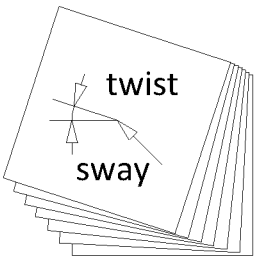

STIFF-TO-FLEXIBLE RISING-TWIST-SWAY SPLIT-FORCE-IMPACT STRUCTURES

CROSS-REFERENCE TO RELATED APPLICATIONS

None.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

This invention pertains to the field of structural engineering. More specifically, the invention pertains to the field of seismic engineering.

Prior art's two main types of structures, stiff monolithic and flexible segmented, are at the two opposite ends of the seismic performance spectrum. Stiff monolithic structures are operational only until the design earthquake level is reached, and then brake. Flexible segmented structures have higher design earthquake level, however, their low stiffness, causing an earlier transition from stiff to flexible state, reduces their operational level far below the operational level of stiff structures.

Prior art building code mostly prescribes stiff monolithic structures, designed to withstand reaction forces in an earthquake by strength as a single solid body. The main problem with the code approach is that the stiff structures resist the full reaction forces at once, which significantly reduces achievable design earthquake level.

Without compromising on stiffness of the structures, negative effects of earthquakes in the stiff structures can be mitigated to some extent by using various prior art methods, such as base isolation and tuned-mass damping.

Prior art research attempts to develop flexible segmented structures designed to reduce reaction forces by letting segments to move relative to each other, proportionally to magnitude of each earthquake. The main problem with the research approach is that stiffness of the flexible segmented structures is far too low to be accepted by the code, which keeps research experiments from influencing the code.

The U.S. Pat. No. 5,502,932 discloses a prior art stiff to flexible segmented high-rise structure with sliding type of joints between a base, a lower, and an upper rigid parts of the structure. Deficiencies of this prior art are as follows. This approach is effective only for horizontal seismic forces. In order to return the parts of the structure back into place, the additional elastic device must be as strong as the earthquake to overcome again the friction of the plates caused by the heavy weight of the structure.

The U.S. Pat. No. 4,106,301 discloses a prior art stiff to flexible segmented low-rise structure with stiff and flexible supports between a base and an upper rigid structure. Deficiencies of this prior art are as follows. This approach again is effective only for horizontal seismic forces. In an earthquake, the stiff supports are failing by buckling and only the flexible supports remain in use. After each earthquake, a new set of stiff supports must replace the failed stiff supports in order to restore the stiffness of the structure.

The U.S. Pat. No. 8,381,463 discloses an implementation of the prior art base isolation technology. Deficiencies of this prior art are as follows. Seismic wave energy is absorbed by friction of granular or liquid material placed in a cavity and no means of returning to the original place of the structure are provided. The granular or the liquid material must be refilled after each shake, which may not be possible in a series of consecutive shakes.

Deficiencies in the prior art design and construction of earthquake-resistant structures can be summarized in a two-fold problem statement as follows:

Unsatisfactory seismic performance of prior art structures, despite excessive cost of prior art design and construction.

BRIEF SUMMARY OF THE INVENTION

This invention presents a plurality of interrelated components of a solution to the stated two-fold problem in the prior art, wherein the solution comprises:

a. improved seismic resistance of structures by transition from stiff to non destructible flexible state at a threshold earthquake level higher than prior art maximum design earthquake level of stiff structures; and at the same time
b. reduced cost of design and construction, compared to the cost in the prior art for design and construction of even less earthquake-resistant structures.

The invention introduces a category of auto-reversing stiff-to-flexible seismic structures, each structure comprising at least one auto-reversing stiff-to-flexible seismic joint, located between at least one upper stiff segment and at least one lower stiff segment of the structure.

The category of structures comprises a threshold ratio determined by design parameters comprising:

a. a rise distance;
b. a sway distance;
c. a twist angle;
d. an inclination angle; and
e. a rise-to-sway ratio.

Functional characteristics of the category of auto-reversing stiff-to-flexible seismic structures comprise:

a. a complete six degree of freedom motion;
b. a laterally-stable limited rising-twist-sway ascent;
c. a self-centering diagonal-untwist auto-descent;
d. a multidirectional flexibility; and
e. a multi-phase split-force-impact seismic protection.

In the multidirectional flexibility, the horizontal component of the force applied to the upper segment can point into any one of the 360 degrees around.

The multi-phase split-force-impact seismic protection comprises:

a. an initial-dissipated-energy side-hit phase;
b. an accumulated-excess-energy ascending phase;
c. a released-excess-energy descending phase; and
d. a final-dissipated-energy down-hit phase.

The seismic split-force-impact technologies for construction of the category of structures comprise:

a. base split-force-impact technology, with significant advantages over prior art base isolation technologies;
b. cluster split-force-impact technology, not having predecessor;
c. tuned segment split-force-impact technology, with significant advantages over prior art tuned-mass damping technologies; and d. tuned spine split-force-impact technology, not having predecessor.

BRIEF DESCRIPTION OF THE SEVERAL VIEWS OF THE DRAWING

In this invention, only conceptual drawings of objects and their parts are provided, because exact drawings will limit the scope of the invention due to the types of their surfaces comprising:

a. a plurality of essential and required surfaces, precisely defined, oriented, and arranged relative to each other, which affect the invention; and b. a plurality of nonessential arbitrary surfaces, undefined and unpredictable because of their possible variety, which do not affect the invention.

Figure 3:
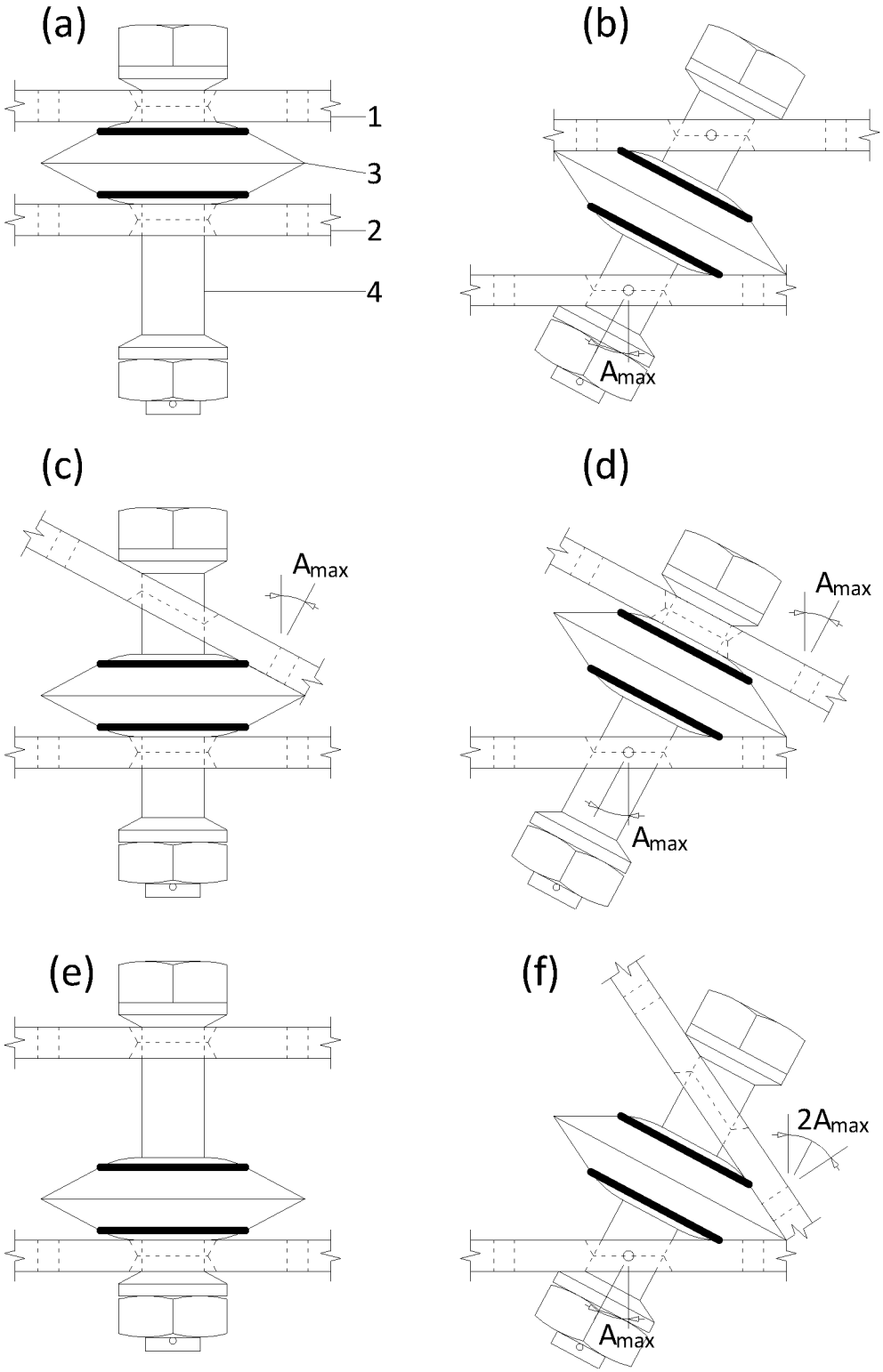

The drawings in FIGS. 1-*a*, 1-*b*, and 1-*c* are an elevation (front) view of a sample segmented high-rise, auto-reversing stiff-to-flexible, rising-twist-sway split-force-impact seismic structure featuring the tuned spine split-force-impact technology, wherein the dashed line rectangles represent initial position, and the solid line rectangles represent the final position of the moving stiff segments of the structure.

The drawings in FIGS. 2-*a*, 2-*b*, and 2-*c* are a plan (top) view of the sample segmented high-rise, auto-reversing stiff-to-flexible, rising-twist-sway split-force-impact seismic structure featuring the tuned spine split-force-impact technology, wherein the solid line rectangles represent the flexible state motion position of the moving stiff segments of the structure, relative to each other.

The drawings in FIG. 3, (a) to (f), show an elevation (front) view of the positions in the six degree of freedom motion of the parts of the auto-reversing stiff-to-flexible seismic joint during the stiff and flexible states motion of the structure.

DETAILED DESCRIPTION OF THE INVENTION

FIG. 1-*a* shows the stiff state of the structure, from which the stiff segments of the structure move relative to each other only in very strong earthquakes, and immediately return firmly into their original stiff state place after every shake without further oscillations. The moment of transition from stiff to flexible state of the structure is determined by design parameters comprising a threshold ratio of horizontal and vertical components of the forces acting on the structure.

FIG. 1-*b* shows the first half of the flexible state motion of the stiff segments of the structure comprising a laterally-stable limited rising-twist-sway ascending motion, which includes the first two phases of the split-force-impact: an initial-dissipated-energy side-hit phase, and an accumulated-excess-energy ascending phase. The lowest segment of the structure moves mostly horizontally due to the ground displacement from the seismic wave at a sway distance. The upper stiff segments gradually lag behind, and also move increasingly upward. The top segment moves mostly up at the rise distance above the height of the stiff state of the structure.

FIG. 1-*c* shows the second half of the flexible state motion of the structure comprising a self-centering diagonal-untwist auto-descending motion, which includes the next two phases of the split-force-impact: a released-excess-energy descending phase, and a final-dissipated-energy down-hit phase. At the end of the ground displacement from the seismic wave, the lowest stiff segment of the structure stops moving together with the ground. The lagging upper segments start the auto-reversing motion centering over the lowest stiff segment, wherein the lower stiff segments fall down and the upper stiff segments gradually fall increasingly sidewise. The top stiff segment moves diagonally, falling down at the rise distance, and, at the same time, moving horizontally at the sway distance, until the entire structure returns back to the initial stiff state.

FIG. 2-*a* shows a rising-twist motion without a sway, in which the same maximum rise distance of the structure is reached at the maximum twist angle of the structure, equal to the sum of the maximum twist angles of the joints, located between each pair of adjacent stiff segments.

FIG. 2-*b* shows a rising-sway motion without a twist, in which the same maximum rise distance of the structure is reached at the maximum sway distance of the structure, equal to the sum of the maximum sway distances of the joints, located between each pair of adjacent stiff segments.

FIG. 2-*c* shows the full rising-twist-sway motion of the structure, in which the same maximum rise distance of the structure is reached at the maximum combination of twist angle and sway distance of the structure, equal to the sum of the maximum twist angles and sway distances of the joints, located between each pair of adjacent stiff segments. In every specific case, the flexible state motion of the segments is a complete six degree of freedom motion comprising three orthogonal translations and three orthogonal rotations, because of unpredictable sequence of previous motions and positions of the stiff segments affecting each other.

The drawings in FIG. 3 show a high specific strength ductile structural material embodiment of the stiff to flexible joint comprising:

a. at least one upper support, marked as 1, attached firmly to an upper stiff segment of a structure, each upper support comprising a lower flat surface and at least one going-through hole;

b. at least one lower support marked as 2, attached firmly to a lower stiff segment of the structure, each lower support comprising a flat upper surface and at least one going-through hole; and c. at least one joint connector attached loosely to the upper support and the lower support, comprising:

i. a limited-distance riser-stopper part marked as 3, comprising a going-through hole; and ii. a limited-angle incliner-stopper part, marked as 4, passing through the upper support hole, the riser-stopper hole, and the lower support hole, in that order.

FIG. 3 (*a*) shows the stiff state of the joint, wherein the lower support 2, which is attached to a not shown lower stiff segment, supports the riser-stopper 3, which supports the upper support 1, which is attached to a not shown upper stiff segment, with the incliner-stopper 4 going through them in a non-engaged vertical position.

FIG. 3 (*b*) shows the rise and sway position of the joint in flexible state at the maximum inclination angle Amax of the incliner-stopper, engaged by the lower and the upper supports in opposite directions. In turn, the incliner-stopper engages and rotates the riser-stopper at the same angle Amax, rising and swaying the upper support, while the lower and the upper supports remain parallel, supported in the same way by adjacent joints.

FIG. 3 (*c*) shows inclination without sway of the upper support at the maximum inclination angle Amax relative to the lower support, with the incliner-stopper and the riser-stopper in vertical position.

FIG. 3 (*d*) shows the rise and sway distance of the joint in flexible state at the maximum inclination angle Amax of the incliner-stopper, engaged by the lower and the upper supports in opposite directions. In turn, the incliner-stopper engages and rotates the riser-stopper at the same angle Amax while the upper support is inclined at the maximum inclination angle Amax relative to the lower support.

FIG. 3 (*e*) shows inclination with full rise and no sway of the upper support at the maximum inclination angle Amax relative to the lower support, with the incliner-stopper and the riser-stopper in vertical position.

FIG. 3 (*f*) shows the rise and sway distance of the joint in flexible state at the maximum inclination angle Amax of the incliner-stopper, engaged by the lower and the upper support in opposite directions. In turn, the incliner-stopper engages and rotates the riser-stopper at the same angle Amax while the upper support is inclined at the double maximum inclination angle 2Amax relative to the lower support.

The limited-distance riser-stopper part comprises:

a. a riser upper flat surface with circular outer edge and an inner edge around the hole;
b. a stopper upper truncated cone lateral surface with:
   i. a smaller diameter circular edge, near to the riser upper outer edge, and
   ii. a larger diameter circular edge;
c. a stopper lower inverted truncated cone lateral surface with:
   i. a larger diameter circular edge near to the stopper upper larger diameter edge; and
   ii. a stopper lower smaller diameter circular edge;
d. a riser lower flat surface, with a circular outer edge, and an inner edge around the other end of the hole, near to the stopper lower smaller diameter edge; and
e. a common axis of symmetry for all surfaces of the riser-stopper, forming a single solid body of revolution.

The limited-angle incliner-stopper part comprises:

a. an incliner-stopper rod;
b. an incliner-stopper head at each of the both ends of the rod, each head comprising an optional stopper truncated cone lateral surface, with:
   i. its smaller diameter edge near the surface of the rod; and
   ii. its larger diameter edge near the rod head; and
c. a common axis of symmetry for all surfaces of the incliner-stopper, forming a single solid body of revolution.

The riser-stopper part and the incliner-stopper part can be joined into one solid body of revolution.

The joint comprises a pointed joint configuration comprising a single joint connector.

The joint comprises a linear joint configuration comprising at least two joint connectors arranged in a strait line.

The joint comprises a planar joint configuration comprising at least three joint connectors arranged not in a strait line.

The joint comprises a multi-plane joint configuration comprising a vertical stack of at least two adjacent planar joint configurations.

In the stiff state of each joint, when the weight of the structure prevails over the lateral forces:

a. the axis of symmetry of the joint is vertical and orthogonal to the flat surfaces of both supports;
b. the flat lower surface of the riser-stopper is coplanar with the upper flat surface of the lower support; and
c. the flat upper surface of the riser-stopper is coplanar with the lower flat surface of the upper support.

At any moment of the flexible state of each joint, when the lateral forces prevail over the weight of the structure:

a. the axis of symmetry of the joint is inclined relative to the flat surfaces of both supports;
b. the outer edge of the lower flat surface of the riser-stopper pushes the upper flat surface of the lower support, causing a rising-sway motion of the riser-stopper; and
c. the outer edge of the upper flat surface of the riser-stopper pushes the lower flat surface of the upper support, causing a rising-sway motion of the upper support.

For the joints with at least two connectors:

a. if inclined axes of all connectors are parallel to each other, the upper stiff segment will only translate up and aside in a limited rising-sway motion, relative to the lower stiff segment; and
b. if inclined axes of all connectors point at different directions, the upper stiff segment will also rotate in a full limited rising-twist-sway motion, relative to the lower stiff segment.

When the limit of the rising-twist-sway motion is reached:

a. the stopper lower truncated cone lateral surface touches the upper flat surface of the lower support and stops inclination of the riser-stopper; and
b. the stopper upper truncated cone lateral surface touches the lower flat surface of the upper support and stops the rising-twist-sway motion of the upper support.

Functional characteristics of the category of auto-reversing stiff-to-flexible seismic structures inherit the functional characteristics of the auto-reversing stiff-to-flexible seismic joints, comprising:

a. a complete six degree of freedom motion;
b. a laterally-stable limited rising-twist-sway ascent;
c. a self-centering diagonal-untwist auto-descent;
d. a multidirectional flexibility; and
e. a multi-phase split-force-impact seismic protection.

The multi-phase split-force-impact seismic protection of the joints and structures comprises:

a. an initial-dissipated-energy side-hit phase;
b. an accumulated-excess-energy ascending phase;
c. a released-excess-energy descending phase; and
d. a final-dissipated-energy down-hit phase.

The invented split-force-impact seismic construction technologies, which depend on number, configuration and location of the joints throughout the structure, further improve the functional characteristics of the category of the auto-reversing stiff-to-flexible seismic structures, increasing their advantages over the prior art structures, because of their cascading cumulative multi-phase split-force-impact at every joint.

The split-force-impact seismic construction technologies comprise:

a. base split-force-impact technology, with significant advantages over prior art base isolation technologies;
b. cluster split-force-impact technology, not having predecessor;
c. tuned segment split-force-impact technology, with significant advantages over prior art tuned-mass damping technologies; and
d. tuned spine split-force-impact technology, not having predecessor.

The base split-force-impact structures have significant advantages over prior art base isolation structures which easily move laterally, relative to the ground, however they do not return in place, or return with decreasing oscillations.

Contrary to the swinging functionality in the prior art, the base split-force-impact structures rise, twist, and sway only in very strong earthquakes above the transition-earthquake level, and immediately return firmly into place after each shake, without any further oscillations.

The cluster split-force-impact structures further improve the base split-force-impact structures by splitting upper stiff segments, which:

a. move centers of gravity up and aside by inclining until leaning to each other at maximum inclination angle of the upper supports of the joint; and b. auto-return back to normal vertical position after external forces cease to exist The tuned segments split-force-impact structures have significant advantages over prior art tuned mass damping structures which support huge additional mass of a heavy pendulum, attached to the top of the structure with the sole purpose to reduce sway of the stiff monolithic structures in strong earthquakes. The tuned segments split-force-impact structures achieve the same effect without any additional mass at the top of the structure.

In the flexible-state with rising-twist-sway six-degree-of-freedom motion, the mass of the upper part of the tuned segments split-force-impact structures plays the same role, and tends to stay in place, or sway much less, compared to the amplitude of the ground shaking.

Instead of wasting strength to support an additional mass, tuned segments split-force-impact structures use their strength to achieve a much higher strongest-earthquake-resistance for the entire structure.

This approach also reduces negative effects of having excessive additional mass at the top on dynamic stability of prior art tuned-mass damping structures.

The tuned segments split-force-impact structures move only above the stiff-to-flexible transition-earthquake level and return firmly into place without any oscillation.

The tuned spine split-force-impact structures have a huge advantage because of the multi-phase split-force-impact seismic protection comprising:

a. an initial-dissipated-energy side-hit phase;

b. an accumulated-excess-energy ascending phase;

c. a released-excess-energy descending phase; and d. a final-dissipated-energy down-hit phase.

The tuned spine split-force-impact structures can split seismic forces into an initial side impact and a sequence of secondary, top-down impacts from the fall of the upper parts of the structure above each one of the multiple joints of the spine.

The structures can keep flexible systems, elevator-ways, and egress-stairways operational in a violent ground shaking and unpredictable six-degree-of-freedom motion, because of the relatively small thickness and movements of the joints, compared to the height of adjacent stiff segments they support.

This invention significantly reduces cost of the stiff-to-flexible structures, which are strong earthquake resistant despite the fact that most of their elements are not, and need not to be strong enough to withstand such an earthquake.

The main advantage of the stiff-to-flexible structures over the prior art is that a very strong earthquake resistance of each structure is achieved with only a partial adequate strength of the whole structure.

It is enough that the stiff-to-flexible joints are totally earthquake resistant, and able to carry overloads from all moving segments above them.

This is so because loads on stiff segments, which are moving and rotating freely and independently from each other, are much lower than the loads on the same elements if the whole structure was a prior art stiff monolithic structure.

On the other hand, the adequate local strength of the compact stiff-to-flexible joints, needed to withstand very strong earthquakes, is much easier and less expensive to achieve, then the adequate distributed strength of the whole prior art stiff structure.

Relatively small and inexpensive, the solid stiff-to-flexible joints can easily handle the concentrated dynamic loads developed in very strong earthquakes.

The parts of the stiff-to-flexible joints are low-cost, simple and easy to manufacture as elements of a construction system due to the following characteristics:

a. a relatively small number of parts of the stiff-to-flexible joints;

b. three-way incremental-shape standard parts, significantly reducing the number of different parts of the joints;

c. interlocking assembly of prefabricated parts of the joints; and d. continuous mass fabrication of predesigned standard parts of the joints.

I claim:

1. A structure comprising at least one auto-reversing stiff-to-flexible seismic joint, located between at least one upper stiff segment and at least one lower stiff segment of the structure, which joint, (shown on FIG. 3 from (a) to (f), comprises at least one joint connector comprising a limited-distance riser-stopper (part 3) comprising:

(a) a riser upper flat surface with circular outer edge;

(b) a stopper upper truncated cone lateral surface with:

(i) a smaller diameter circular edge, near to the riser upper outer edge; and (ii) a larger diameter circular edge;

(c) a stopper lower inverted truncated cone lateral surface with:

(i) a larger diameter circular edge near to the stopper upper larger diameter edge; and (ii) a stopper lower smaller diameter circular edge;

(d) a riser lower flat surface, with a circular outer edge, near to the stopper lower smaller diameter edge; and (e) a common axis of symmetry for all surfaces of the riser-stopper, forming a single solid body of revolution.

2. The structure of claim 1, wherein the stiff to flexible joint comprises:

(a) at least one upper support (1), attached firmly to an upper stiff segment of a structure, each upper support comprising a lower flat surface and at least one going-through hole;

(b) at least one lower support (2), attached firmly to a lower stiff segment of the structure, each lower support comprising a flat upper surface and at least one going-through hole; and (c) the joint connector attached loosely to the upper support and the lower support, comprising:

(i) the limited-distance riser-stopper (part 3) comprising a going-through hole; and (ii) a limited-angle incliner-stopper (part 4), passing through the upper support hole, the riser-stopper hole, and the lower support hole, in that order, which limited-angle incliner-stopper part comprises:

(iia) an incliner-stopper rod;

(iib) an incliner-stopper head at each of the both ends of the rod, each head comprising a stopper truncated cone lateral surface, with:

(iibi) its smaller diameter edge near the surface of the rod; and (iibii) its larger diameter edge near the rod head; and (iic) a common axis of symmetry for all surfaces of the incliner-stopper, forming a single solid body of revolution.

3. The structure of claim 2, wherein the riser-stopper (part 3) and the incliner-stopper (part 4) are joined into one solid body of revolution.

4. The structure of claim 2, wherein:

(a) in the stiff state of each joint, when the weight of the structure prevails over the lateral forces:

(i) the axis of symmetry of the joint is vertical and orthogonal to the flat surfaces of both supports;

(ii) the flat lower surface of the riser-stopper is coplanar with the upper flat surface of the lower support; and (iii) the flat upper surface of the riser-stopper is coplanar with the lower flat surface of the upper support;

(b) at any moment of the flexible state of each joint, when the lateral forces prevail over the weight of the structure:

(i) the axis of symmetry of the joint is inclined relative to the flat surfaces of both supports;

(ii) the outer edge of the lower flat surface of the riser-stopper pushes the upper flat surface of the lower support, causing a rising-sway motion of the riser-stopper; and (iii) the outer edge of the upper flat surface of the riser-stopper pushes the lower flat surface of the upper support, causing a rising-sway motion of the upper support; and (c) when the limit of the rising-twist-sway motion is reached:

(i) the stopper lower truncated cone lateral surface touches the upper flat surface of the lower support and stops inclination of the riser-stopper; and (ii) the stopper upper truncated cone lateral surface touches the lower flat surface of the upper support and stops the rising-twist-sway motion of the upper support.

5. The structure of claim 1, wherein:

(a) for the joints with at least two connectors:

(i) if inclined axes of all connectors are parallel to each other, the upper stiff segment will only translate up and aside in a limited rising-sway motion, relative to the lower stiff segment; and (ii) if inclined axes of all connectors point at different directions, the upper stiff segment will also rotate in a full limited rising-twist-sway motion, relative to the lower stiff segment.

6. The structure of claim 1, wherein the joint comprises a pointed joint configuration comprising a single joint connector.

7. The structure of claim 1, wherein the joint comprises a linear joint configuration comprising at least two joint connectors arranged in a strait line.

8. The structure of claim 1, wherein the joint comprises a planar joint configuration comprising at least three joint connectors arranged not in a strait line.

9. The structure of claim 8, wherein the joint comprises a multi-plane joint configuration comprising a vertical stack of at least two adjacent planar joint configurations.

10. The structure of claim 1, wherein the parts of the stiff-to-flexible joints are low-cost, simple and easy to manufacture as elements of a construction system due to the following characteristics:

(a) a relatively small number of parts of the stiff-to-flexible joints;

(b) three-way incremental-shape standard parts, significantly reducing the number of different parts of the joints;

(c) interlocking assembly of prefabricated parts of the joints; and (d) continuous mass fabrication of predesigned standard parts of the joints.

* * * * *